US010522121B1

(12) United States Patent
Liao

(10) Patent No.: US 10,522,121 B1
(45) Date of Patent: Dec. 31, 2019

(54) ECCENTRICALLY-ARRANGED AUTOMATIC RESTORING STRIKING STRUCTURE

(71) Applicant: Tsun-Chi Liao, Taichung (TW)

(72) Inventor: Tsun-Chi Liao, Taichung (TW)

( * ) Notice: Subject to any disclaimer, the term of this patent is extended or adjusted under 35 U.S.C. 154(b) by 0 days.

(21) Appl. No.: 16/438,915

(22) Filed: Jun. 12, 2019

(51) Int. Cl.
*G10D 13/00* (2006.01)

(52) U.S. Cl.
CPC ..... *G10D 13/006* (2013.01)

(58) Field of Classification Search
CPC ..... G10D 13/006; G10D 13/00
See application file for complete search history.

(56) References Cited

U.S. PATENT DOCUMENTS 6,822,149 B1 11/2004 Liao
9,236,038 B1 1/2016 Hirasawa
2013/0233149 A1* 9/2013 Meyerson ..... G10D 13/006 84/422.1

* cited by examiner

*Primary Examiner* — Kimberly R Lockett
(74) *Attorney, Agent, or Firm* — Muncy, Geissler, Olds & Lowe, P.C.

(57) ABSTRACT

The invention comprises a striking rod, a rotating shaft, a stand and an elastic element, wherein the rotating shaft comprises a shaft body where the striking rod is disposed, two side ends on two sides of the shaft body, and a protrusion arranged on the shaft body and opposite to the striking rod. The stand comprises a base and two columns arranged on two sides of the base. The two columns are respectively provided with a socket tube pivotally connected to the side end, and a locking hole. The locking hole is located below the socket tube and is offset towards a musical instrument. Two ends of the elastic element are respectively fixed to the locking hole and an engaging element. Since the socket tube is not on the same vertical line as the locking hole, an initial position of the striking rod is offset away from the musical instrument.

6 Claims, 4 Drawing Sheets

ECCENTRICALLY-ARRANGED AUTOMATIC RESTORING STRIKING STRUCTURE

FIELD OF THE INVENTION

The present invention relates to a striking rod of a musical instrument, in particular to an automatic restoring striking structure of a musical instrument.

BACKGROUND OF THE INVENTION

For example, U.S. Pat. Nos. 6,822,149 B1 and 9,236,038 B1 respectively disclose a pedal striking device for striking a musical instrument such as a drum. The pedal striking device structurally mainly comprises a striking rod, a pedal, a stand and a restoring element, wherein the striking rod is pivotally connected to the stand through a rotating shaft. When the pedal is stepped on, the rotating shaft is pulled, and the striking rod is rotated by taking the stand as a fulcrum, such that the striking rod is moved from an initial position to a striking position. The musical instrument is placed in the striking position, so that the striking rod hits the musical instrument and makes a sound. Further, the restoring element is disposed between the stand and the rotating shaft. When the rotating shaft rotates, the restoring element may drive the rotating shaft to return to an angle before the rotation, and the striking rod may be driven back to the initial position from the striking position.

Referring to FIGS. 3 and 4 of U.S. Pat. No. 6,822,149 B1, in U.S. Pat. No. 6,822,149 B1, an elongated through hole (461) is formed in a stand (20). The restoring element (49) is first fixed to a movable top block (48), the movable top block (48) is then pivotally connected to the elongated through hole (461), and the restoring element (49) is further pivotally connected to a joint (41) of the rotating shaft (21). Since two ends of the restoring element (49) are rotatable relative to the joint (41) and the elongated through hole (461), when the striking rod (23) swings between the striking position and the initial position, the restoring element (49) is not distorted because of a shear force. That is, a restoring force of the restoring element (49) may quickly drive the striking rod (23) back to the initial position, making the movement of the striking rod (23) more flexible and faster.

Referring again to FIG. 2 of U.S. Pat. No. 9,236,038 B1, in U.S. Pat. No. 9,236,038 B1, by the technical solution that a rocking fulcrum (F16) of a coil spring (16) is arranged on the lower surface of a stand (30) that contacts an adjusting nut (28), a shaking angle of a spring is made smaller when a pedal is operated, the stability of the pedal is increased, and the operability of the pedal is improved.

The prior art as described above aims to increase the motion sensitivity of the striking rod and the operability of the pedal. However, the prior art as described above apparently fail to be characterized by increasing the striking force of the striking rod. When a player needs a large striking force, he may only increase the strength of stepping on the pedal. Thus, it is common for the player to cause a problem that a stepping position is out of alignment or out of control. Obviously, there is a need for improvement.

SUMMARY OF THE INVENTION

Therefore, the main objective of the present invention is to disclose an eccentrically-arranged automatic restoring striking structure, to increase a striking force of a striking rod.

To fulfill said objective, the present invention relates to an eccentrically-arranged automatic restoring striking structure, which is used for striking a musical instrument and comprises a striking rod, a rotating shaft, a stand and an elastic element, wherein the striking rod is disposed on the rotating shaft; the rotating shaft is provided with a shaft body, two side ends and a protrusion, wherein the striking rod is disposed on the shaft body; the two side ends are located on two sides of the shaft body; the protrusion is disposed on the shaft body and opposite to the striking rod; the protrusion is provided with an engaging element opposite to the shaft body.

The stand is provided with a base and two columns symmetrically arranged on two sides of the base; each of the two columns is provided with a socket tube pivotally connected to one of the two side ends of the rotating shaft, and a locking hole, the locking hole is not on the same vertical line as the socket tube, and the locking hole is located below the socket tube and is offset towards the direction of the musical instrument; two ends of the elastic element are fixed to the locking hole and the engaging element respectively, and the elastic element is in a tensile state.

Accordingly, by the structure design in which "the socket tube is not on the same vertical line as the locking hole, and the locking hole is offset towards the direction of the musical instrument", the protrusion is opposite to the striking rod. Thus, when the elastic element drags the protrusion to offset towards the direction of the musical instrument, the striking rod has a greater distance relate to the musical instrument. That is, an initial position of the striking rod is offset away from the direction of the musical instrument, and a moving distance of the striking rod may be increased, that is, the striking rod may have a longer acceleration distance and increases a striking force.

DETAILED DESCRIPTION OF THE PREFERRED EMBODIMENTS

Figure 1:
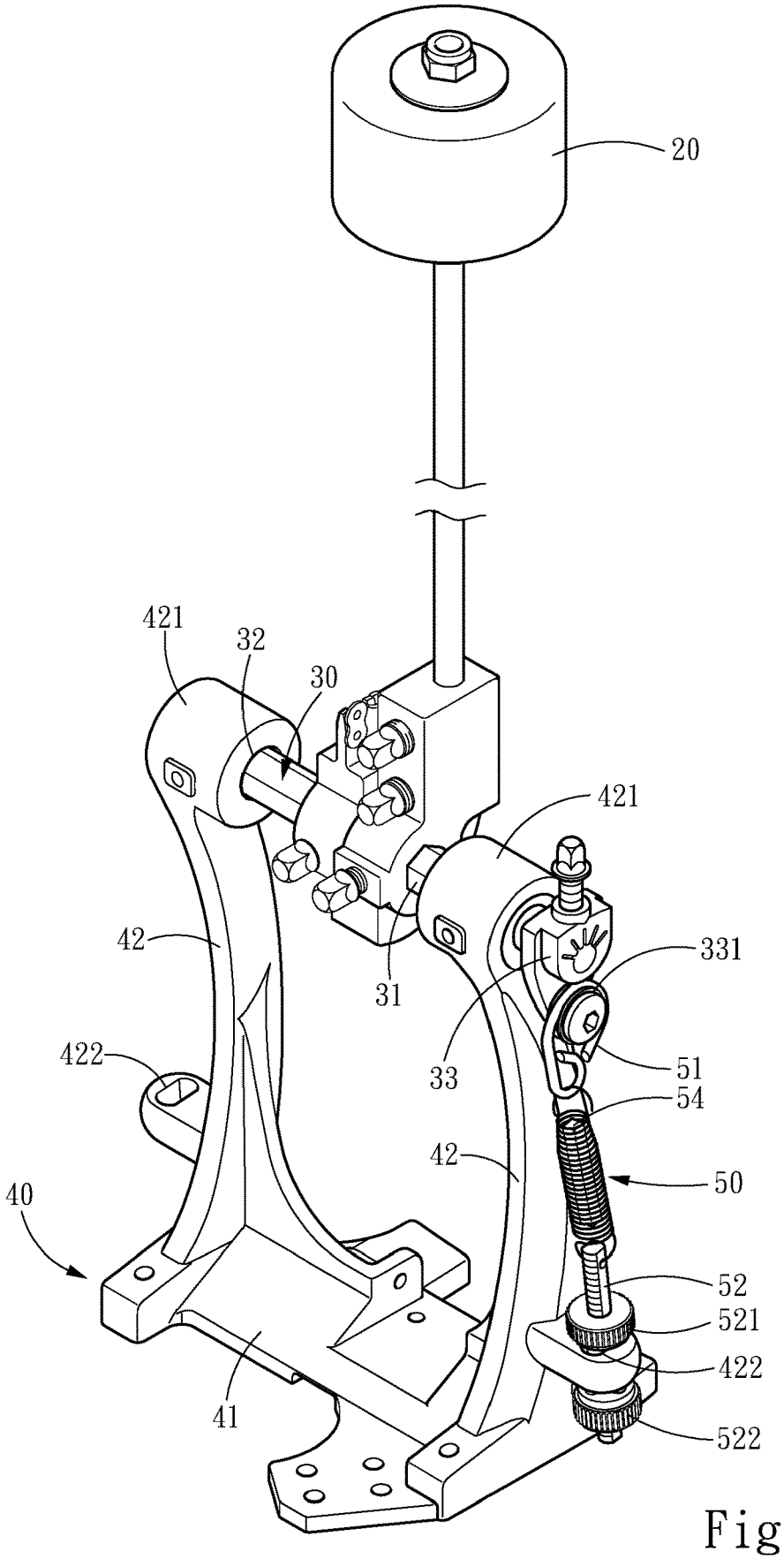
FIG. 1 is a structural diagram of an automatic restoring striking structure of the present invention.
Figure 2:
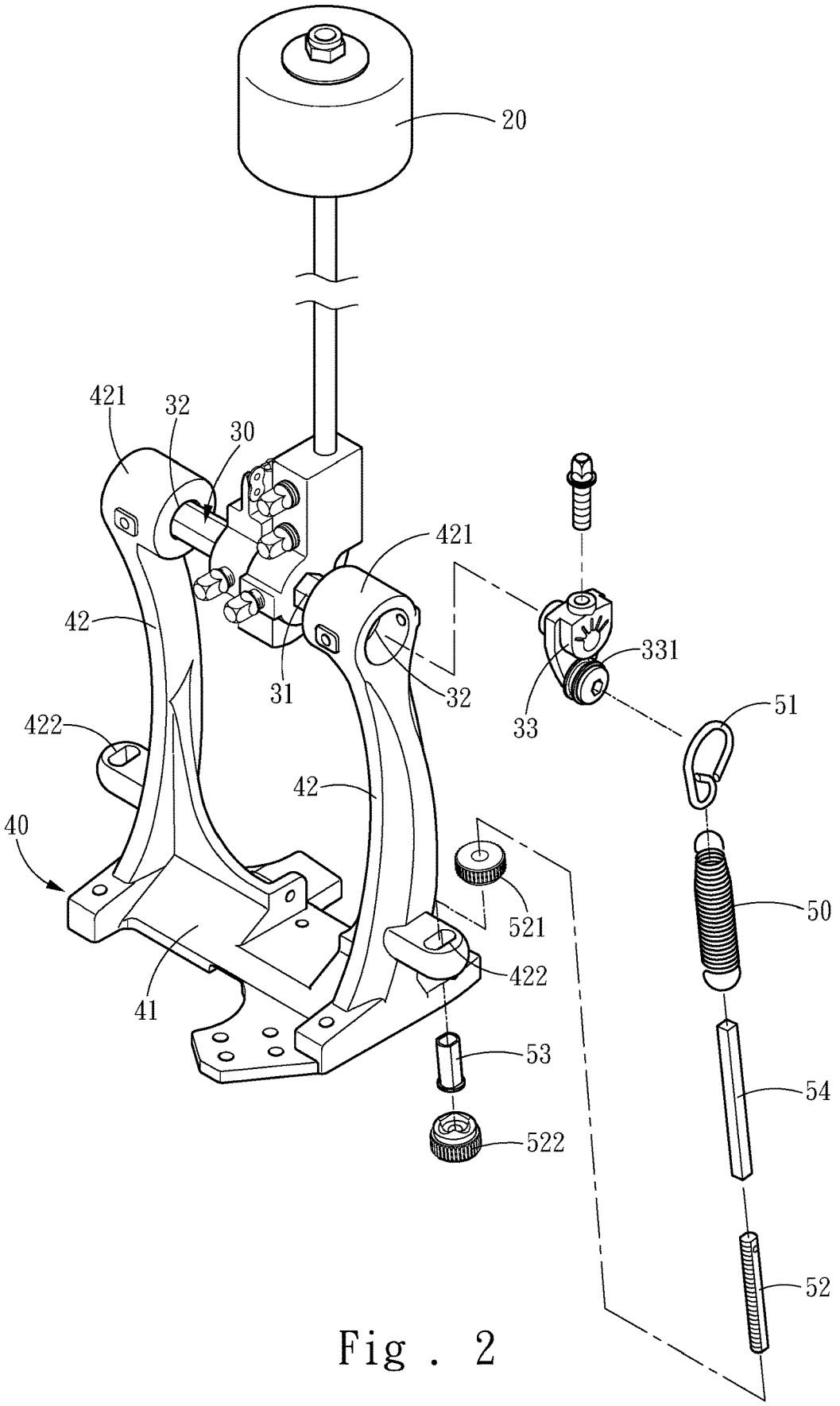
FIG. 2 is an exploded view of the automatic restoring striking structure of the present invention.
Figure 3:
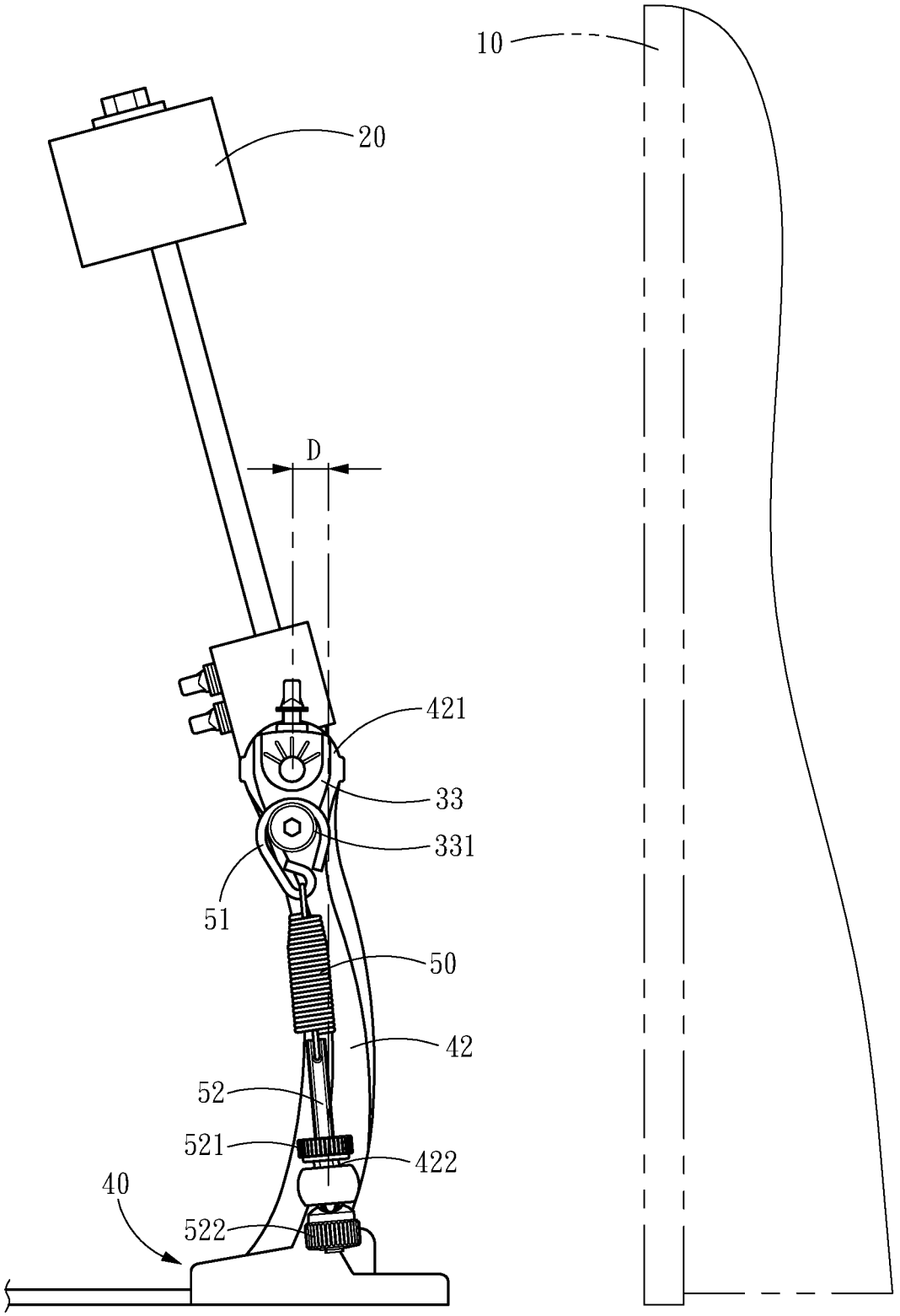
FIG. 3 is a structural side view of a musical instrument support bar of the present invention.

The technical contents, features and efficacies of the present invention will be apparent from the detailed description of the preferred embodiments of the present invention by reference to the drawings.

As shown in FIGS. 1, 2, 3, and 4, the present invention relates to an eccentrically-arranged automatic restoring striking structure, which is used for striking a musical instrument 10 and comprises a striking rod 20, a rotating shaft 30, a stand 40 and an elastic element 50, wherein the striking rod 20 is disposed on the rotating shaft 30. The rotating shaft 30 is provided with a shaft body 31, two side ends 32 and a protrusion 33, wherein the striking rod 20 is disposed on the shaft body 31. The two side ends 32 are located on two sides of the shaft body 31. The protrusion 33 is disposed on the shaft body 31 and opposite to the striking rod 20, and the protrusion 33 is provided with an engaging element 331 opposite to the shaft body 31.

The stand 40 is provided with a base 41 and two columns 42, and the two columns 42 are symmetrically arranged on two sides of the base 41. Each of the two columns 42 is provided with a socket tube 421 and a locking hole 422. The two socket tubes 421 are respectively and pivotally connected to the two side ends 32 of the rotating shaft 30. Further, the locking hole 422 is not on the same vertical line as the socket tube 421, and the locking hole 422 is located below the socket tube 421 and is offset towards a direction of the musical instrument 10. Two ends of the elastic element 50 are fixed to the locking hole 422 and the engaging element 331 respectively, and the elastic element is in a tensile state.

In addition, the position of the protrusion 33 disposed on the shaft body 31 may be adjacent to any one of the two side ends 32 according to the requirements in use. The engaging element 331 may be a sheave. The elastic element 50 may be a tension spring. One end of the elastic element 50 is connected to a hook 51, and the hook 51 is buckled to the engaging element 331. In addition, the locking hole 422 may be an elongated hole. The other end, opposite to the hook 51, of the elastic element 50 is connected to a threaded column 52. The threaded column 52 passes through the locking hole 422, and the threaded column 52 is screwed with an upper nut 521 and a lower nut 522 at two sides of the locking hole 422 respectively. A protective bush 53 may further be arranged between the threaded column 52 and the locking hole 422. The protective bush 53 prevents the threaded column 52 from directly contacting the locking hole 422, thereby prolonging the service life of the threaded column 52 and the locking hole 422. In addition, a long rod 54 may penetrate into the elastic element 50. The long rod 54 is able to provide a rigidity structure to protect the elastic element 50 from being twisted by an external force.

Figure 4:
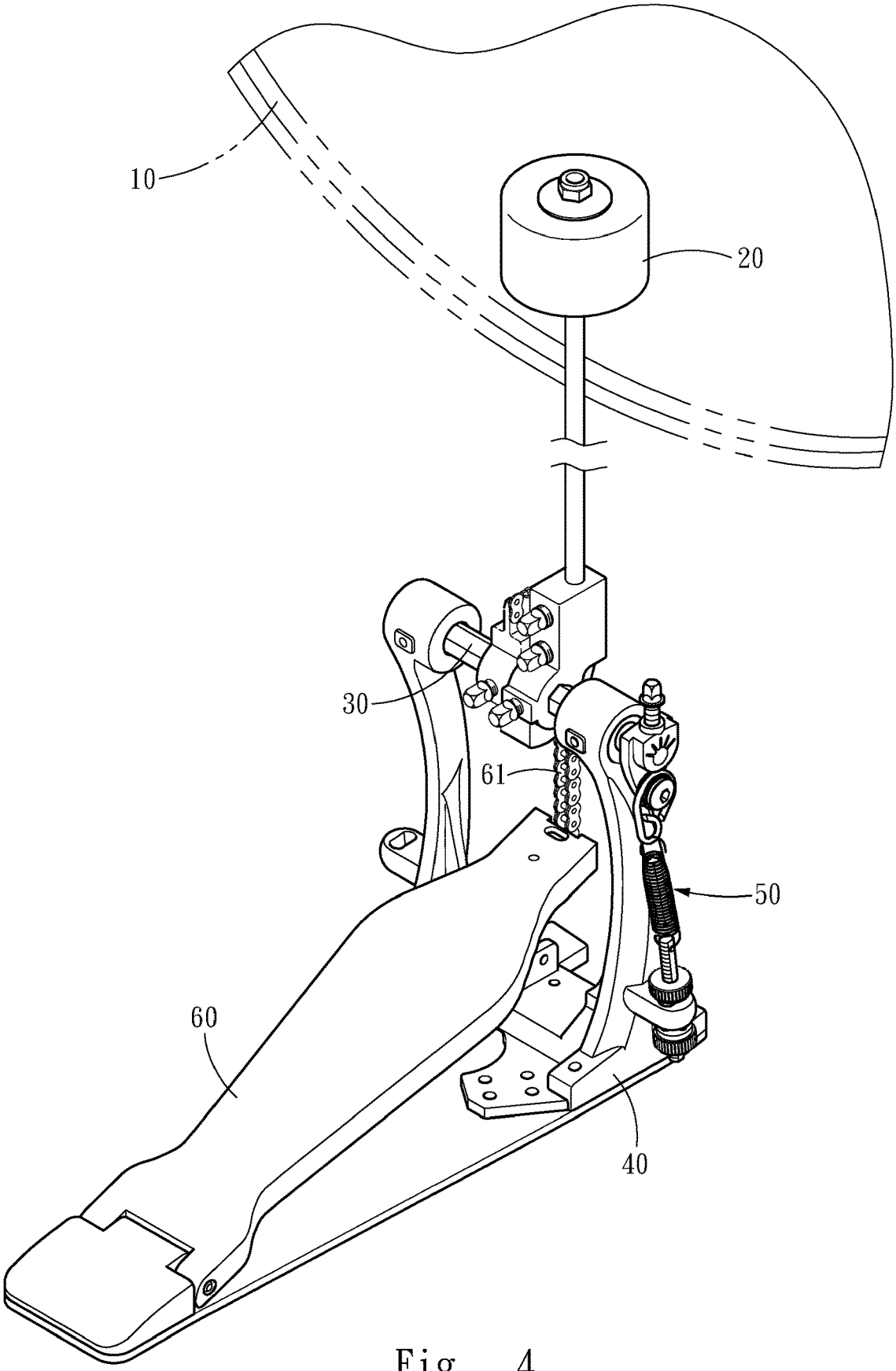
FIG. 4 is a schematic diagram in installation and use of the present invention.

As shown in FIG. 4, in practical use, the automatic restoring striking structure is integrated with a pedal 60. The pedal 60 drives the rotating shaft 30 to rotate through a chain 61. When the rotating shaft 30 rotates, the striking rod 20 is driven to strike the musical instrument 10 to make a sound.

As shown in FIG. 3 again, since the locking hole 422 is offset towards the direction of the musical instrument 10 by a distance of D, and the protrusion 33 protrudes towards the direction opposite to the striking rod 20. When the pedal 60 is not stepped on, the elastic element 50 drags the protrusion 33 toward the musical instrument 10, so that the striking rod 20 is moved away from the musical instrument 10. That is, an initial position of the striking rod 20 is offset away from the musical instrument 10, thereby increasing a moving distance of the striking rod 20. In other words, the striking rod 20 may have a longer acceleration distance and may generate a higher striking force.

As stated above, the present invention at least includes the following features:

1. By the technical feature that the socket tube is not on the same vertical line as the locking hole, the striking force of the striking rod is increased. More specifically, since the locking hole is offset towards the direction of the musical instrument and the protrusion protrudes towards the direction opposite to the striking rod, the elastic element drags the protrusion to offset towards the direction of the musical instrument, that is, the striking rod is moved away from the musical instrument. Therefore, an initial position of the striking rod is offset away from the musical instrument, and a moving distance of the striking rod may be increased, that is, the striking rod may have a longer acceleration distance and increases a striking force.

2. The protective bush may further be arranged between the threaded column and the locking hole. The protective bush may prevent the threaded column from directly contacting the locking hole, thereby prolonging the service life of the threaded column and the locking hole.

3. When the long rod penetrates into the elastic element, the structural rigidity of the long rod may resist the compression from the external force to avoid distortion of the elastic element.

What is claimed is:

1. An eccentrically-arranged automatic restoring striking structure, which is used for striking a musical instrument, comprising:

a striking rod;

a rotating shaft on which the striking rod is disposed, wherein the rotating shaft is provided with a shaft body on which the striking rod is disposed, two side ends on two sides of the shaft body, and a protrusion arranged on the shaft body and opposite to the striking rod, the protrusion being provided with an engaging element opposite to the shaft body;

a stand which is provided with a base and two columns symmetrically arranged on two sides of the base, wherein each of the two columns is provided with a socket tube pivotally connected to one of the two side ends of the rotating shaft, and a locking hole, the locking hole is not on the same vertical line as the socket tube, and the locking hole is located below the socket tube and is offset towards the musical instrument; and an elastic element, wherein two ends of the elastic element are fixed to the locking hole and the engaging element respectively, and the elastic element is in a tensile state.

2. The eccentrically-arranged automatic restoring striking structure according to claim 1, wherein the protrusion is adjacent to any one of the two side ends of the rotating shaft.

3. The eccentrically-arranged automatic restoring striking structure according to claim 1, wherein the engaging element includes a sheave; the elastic element includes a tension spring; one end of the elastic element is connected to a hook, and the hook is buckled to the engaging element.

4. The eccentrically-arranged automatic restoring striking structure according to claim 3, wherein the locking hole is an elongated hole; the other end, opposite to the hook, of the elastic element is connected to a threaded column, the threaded column passes through the locking hole, and the threaded column is screwed with an upper nut and a lower nut at two sides of the locking hole respectively.

5. The eccentrically-arranged automatic restoring striking structure according to claim 4, wherein a protective bush is further disposed between the threaded column and the locking hole.

6. The eccentrically-arranged automatic restoring striking structure according to claim 3, wherein a long rod penetrates into the elastic element.

* * * * *